US008201339B1

(12) United States Patent
Walker

(10) Patent No.: US 8,201,339 B1
(45) Date of Patent: Jun. 19, 2012

(54) COMPOUND BOW PEEP SIGHT SYSTEM

(76) Inventor: James A. Walker, Clearwater, FL (US)

( * ) Notice: Subject to any disclaimer, the term of this patent is extended or adjusted under 35 U.S.C. 154(b) by 0 days.

(21) Appl. No.: 13/068,790

(22) Filed: May 20, 2011

Related U.S. Application Data

(60) Provisional application No. 61/350,607, filed on Jun. 2, 2010.

(51) Int. Cl.
*F41G 1/467* (2006.01)

(52) U.S. Cl. ..... 33/265; 124/87

(58) Field of Classification Search ..... 33/265; 124/87, 90

See application file for complete search history.

(56) References Cited

U.S. PATENT DOCUMENTS

| | | | | | |
|---|---|---|---|---|---|
| 4,011,853 | A * | 3/1977 | Fletcher | 124/87 |
| 5,056,498 | A * | 10/1991 | Scherz | 124/87 |
| 5,080,084 | A * | 1/1992 | Kendall et al. | 124/87 |
| 5,137,007 | A * | 8/1992 | Shoemake et al. | 124/87 |
| 5,325,598 | A * | 7/1994 | Hall et al. | 33/265 |
| 5,347,976 | A * | 9/1994 | Saunders | 124/87 |
| 5,860,408 | A * | 1/1999 | Summers | 124/87 |
| 6,981,329 | B1 * | 1/2006 | Strathman | 33/265 |
| 7,543,389 | B2 * | 6/2009 | Grace, Jr. | 33/265 |
| 2003/0019118 | A1 * | 1/2003 | Wilson | 33/265 |
| 2007/0119060 | A1 * | 5/2007 | Grace | 33/265 |
| 2008/0066328 | A1 * | 3/2008 | Bohn | 33/265 |

* cited by examiner

*Primary Examiner* — Yaritza Guadalupe-McCall

(57) ABSTRACT

An exterior surface has a vertical mid-plane and a horizontal aperture there through. An annular recess is provided at the vertical mid-plane. The exterior surface has planar end faces parallel with each other. The horizontal aperture has opposed frusto-conical surfaces with a central axis. The frusto-conical surfaces have interior edges at the vertical mid-plane and exterior edges at the planar end faces. The exterior edges are larger than the interior edges. Coupling grooves extend to opposite sides of the recess. The coupling grooves have a generally semi-circular configuration. The grooves are parallel with each other at an angle with respect to the central axis. The grooves have midpoints spanning the central axis. The coupling grooves are adapted to receive separated strands of draw string.

1 Claim, 2 Drawing Sheets

FIG. 1
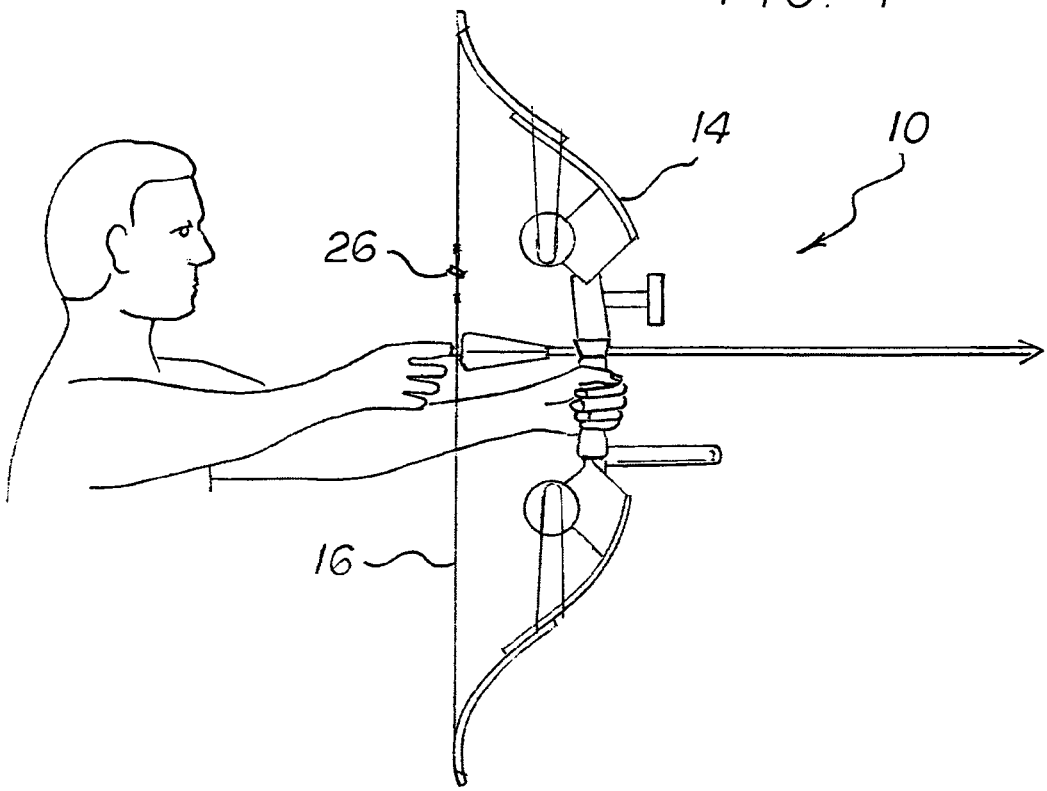
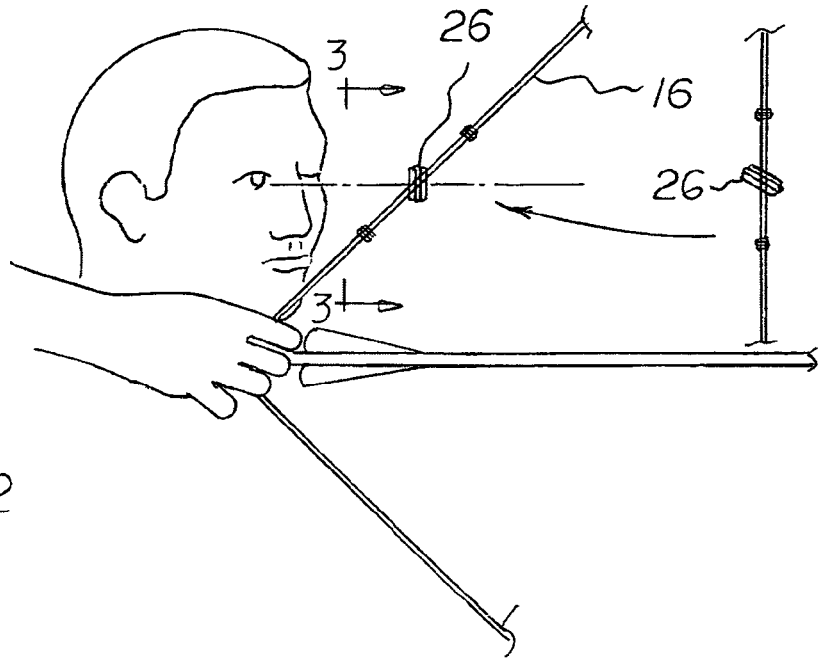
FIG. 2

FIG. 3
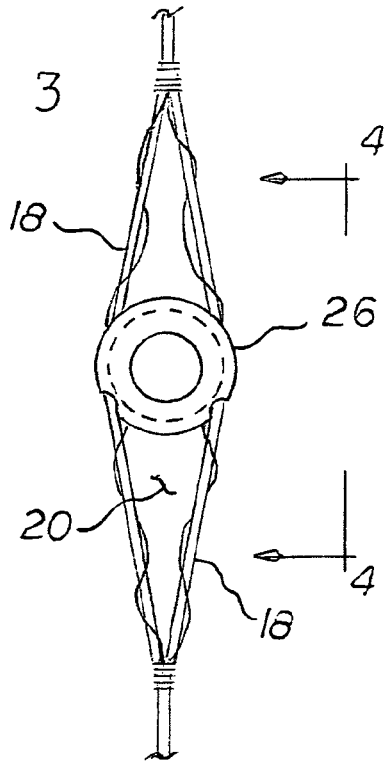
FIG. 4
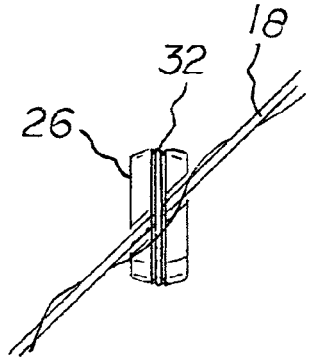
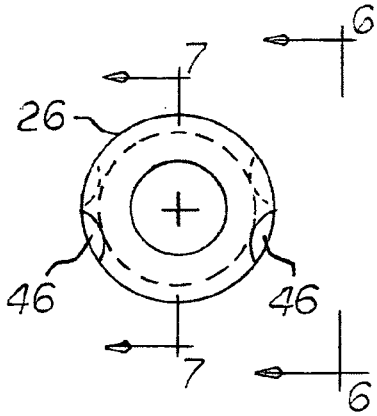
FIG. 5
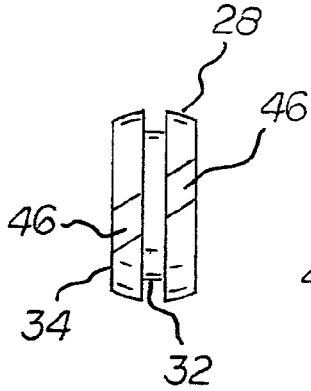
FIG. 6
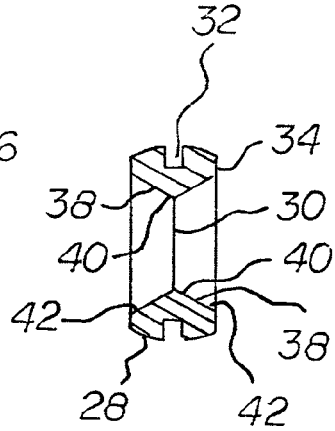
FIG. 7

COMPOUND BOW PEEP SIGHT SYSTEM

RELATED APPLICATION

The present non-provisional patent application is based upon Provisional Patent Application Ser. No. 61/350,607 filed Jun. 2, 2010, the subject matter of which is incorporated herein by reference.

BACKGROUND OF THE INVENTION

Field of the Invention

The present invention relates to a compound bow peep sight system and more particularly pertains to positioning a peep sight to facilitate sighting a target with a compound bow, the positioning and sighting being done in a safe, accurate, convenient and economical manner.

SUMMARY OF THE INVENTION

In view of the foregoing disadvantages inherent in the known types of sight systems of known designs and configurations now present in the prior art, the present invention provides an improved compound bow peep sight system. As such, the general purpose of the present invention, which will be described subsequently in greater detail, is to provide a new and improved compound bow peep sight system and method which has all the advantages of the prior art and none of the disadvantages.

To attain this, the present invention essentially comprises a compound bow peep sight system. First provided is a compound bow. The compound bow has a draw string. The compound bow has bow upper and lower ends. The compound bow has a bow central extent. The draw string has upper and lower draw string ends. The upper and lower draw string ends are coupled to the upper and lower bow ends. The draw string has a draw string central extent. The draw string has separated strands. In this manner an opening is formed. The opening is provided between the separated strands. The separated strands are located between the draw string central extent and the draw string upper end. The draw string is adapted to be drawn by a user from an angled undrawn orientation to a vertical orientation when drawn.

A peep sight is provided. The peep sight is positioned within the opening in the draw string. The peep sight has an exterior surface. The exterior surface is provided externally. The exterior surface is generally bi-convex (M & M shaped). The exterior surface has a vertical mid-plane. The vertical mid-plane has a horizontal aperture. The horizontal aperture is provided through the vertical mid-plane when in the undrawn orientation. The exterior surface of the peep sight has an annular recess. The annular recess is provided at the vertical mid-plane. The annular recess has a rectangular cross sectional configuration. The annular recess has a width and a depth. The width and the depth of the recess are essentially equal. The exterior surface of the peep sight has planar end faces. The end faces are provided parallel with each other. The end faces are vertically oriented when in the drawn orientation.

The horizontal aperture has a central axis. The horizontal aperture has opposed frusto-conical surfaces. The frusto-conical surfaces are provided entirely around the central axis. The frusto-conical surfaces have interior edges. The interior edges are provided at the vertical mid-plane. The frusto-conical surfaces have exterior edges. The exterior edges are provided at the planar end faces. The exterior edges are larger than the interior edges. The frusto-conical surfaces form an angle of 60 degrees, plus or minus 10 percent.

Provided last are coupling grooves. The coupling grooves are formed in the exterior surface of the peep sight. The coupling grooves extend to opposite sides of the recess. The coupling grooves have a generally semi-circular configuration. The coupling grooves have a depth. The depth of the coupling grooves is essentially equal to the depth of the recess. The grooves are provided parallel with each other. The grooves are provided at an angle of 34 degrees, plus or minus 10 percent. The grooves have midpoints. The midpoints span the central axis. The coupling grooves receive the separated strands whereby. In this manner when the draw string is drawn, the peep sight will rise to a level of an eye of the user with the opening and central axis in an intended direction of the target.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved compound bow peep sight system which has all of the advantages of the prior art sight systems of known designs and configurations and none of the disadvantages.

It is another object of the present invention to provide a new and improved compound bow peep sight system which may be easily and efficiently manufactured and marketed.

It is further object of the present invention to provide a new and improved compound bow peep sight system which is of durable and reliable constructions.

An even further object of the present invention is to provide a new and improved compound bow peep sight system which is susceptible of a low cost of manufacture with regard to both materials and labor, and which accordingly is then susceptible of low prices of sale to the consuming public, thereby making such compound bow peep sight system economically available to the buying public.

Even still another object of the present invention is to provide a compound bow peep sight system for positioning a peep sight to facilitate sighting a target with a compound bow, the positioning and sighting being done in a safe, accurate, convenient and economical manner.

Lastly, it is an object of the present invention to provide a new and improved compound bow peep sight system. An exterior surface has a vertical mid-plane and a horizontal aperture there through. An annular recess is provided at the vertical mid-plane. The exterior surface has planar end faces parallel with each other. The horizontal aperture has opposed frusto-conical surfaces with a central axis. The frusto-conical surfaces have interior edges at the vertical mid-plane and exterior edges at the planar end faces. The exterior edges are larger than the interior edges. Coupling grooves extend to opposite sides of the recess. The coupling grooves have a generally semi-circular configuration. The grooves are parallel with each other at an angle with respect to the central axis. The grooves have midpoints spanning the central axis. The coupling grooves are adapted to receive separated strands of a draw string.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a compound bow peep sight system constructed in accordance with the principles of the present invention.

FIG. 2 is an enlarged illustration of a portion of the system shown in FIG. 1 but in the drawn orientation.

FIG. 3 is a front elevational view of the peep sight taken along line 3-3 of FIG. 2.

FIG. 4 is a side elevational view of the peep sight taken along line 4-4 of FIG. 3.

FIG. 5 is an enlarged front elevational view of the peep sight shown in FIG. 3.

FIG. 6 is a side elevational view of the peep sight taken along line 6-6 of FIG. 5.

FIG. 7 is a cross sectional view of the peep sight taken along line 7-7 of FIG. 5.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved compound bow peep sight system embodying the principles and concepts of the present invention and generally designated by the reference numeral 10 will be described.

The present invention, the compound bow peep sight system 10 is comprised of a plurality of components. Such components in their broadest context include an exterior surface and coupling grooves. Such components are individually configured and correlated with respect to each other so as to attain the desired objective.

First provided is a compound bow 14. The compound bow has a draw string 16. The compound bow has bow upper and lower ends. The compound bow has a bow central extent. The draw string has upper and lower draw string ends. The upper and lower draw string ends are coupled to the upper and lower bow ends. The draw string has a draw string central extent. The draw string has separated strands 18. In this manner an opening 20 is formed. The opening is provided between the separated strands. The separated strands are located between the draw string central extent and the draw string upper end. The draw string is adapted to be drawn by a user from an angled undrawn orientation to a vertical orientation when drawn.

A peep sight 26 is provided. The peep sight is positioned within the opening in the draw string. The peep sight has an exterior surface 28. The exterior surface is provided externally. The exterior surface is generally bi-convex (M & M shaped). The exterior surface has a vertical mid-plane. The vertical mid-plane has a horizontal aperture 30. The horizontal aperture is provided through the vertical mid-plane when in the drawn orientation. The exterior surface of the peep sight has an annular recess 32. The annular recess is provided at the vertical mid-plane. The annular recess has a rectangular cross sectional configuration. The annular recess has a width and a depth. The width and the depth of the recess are essentially equal. The exterior surface of the peep sight has planar end faces 34. The end faces are provided parallel with each other. The end faces are vertically oriented when in the drawn orientation.

The horizontal aperture has a central axis. The horizontal aperture has opposed frusto-conical surfaces 38. The frusto-conical surfaces are provided entirely around the central axis. The frusto-conical surfaces have interior edges 40. The interior edges are provided at the vertical mid-plane. The frusto-conical surfaces have exterior edges 42. The exterior edges are provided at the planar end faces. The exterior edges are larger than the interior edges. The frusto-conical surfaces form an angle of 60 degrees, plus or minus 10 percent.

Provided last are coupling grooves 46. The coupling grooves are formed in the exterior surface of the peep sight. The coupling grooves extend to opposite sides of the recess. The coupling grooves have a generally semi-circular configuration. The coupling grooves have a depth. The depth of the coupling grooves is essentially equal to the depth of the recess. The grooves are provided parallel with each other. The grooves are provided at an angle of 34 degrees, plus or minus 10 percent. The grooves have midpoints. The midpoints span the central axis. The coupling grooves receive the separated strands whereby. In this manner when the draw string is drawn, the peep sight will rise to a level of an eye of the user with the opening and central axis in an intended direction of the target.

Note is taken that FIGS. 3 and 4 illustrate supplemental strands laterally spanning the opening 20 and extending vertically between windings at the upper and lower ends of the opening. Such supplemental strands are optional and function to hold together the separated strands 18 by the windings at the top and bottom of the opening.

As to the manner of usage and operation of the present invention, the same should be apparent froth the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A compound bow peep sight system (10) for positioning a peep sight to facilitate sighting a target with a compound bow, the positioning and sighting being done in a safe, accurate, convenient and economical manner, the system comprising, in combination:

a compound bow (14) with a draw string (16), the compound bow having bow upper and lower ends and a bow central extent, the draw string having upper and lower draw string ends coupled the upper and lower bow ends, the draw string having a draw string central extent, the draw string having separated strands (18) forming an opening (20) between the separated strands, the separated strands being located between the draw string central extent and the draw string upper end, the draw string adapted to be drawn by a user from an angled undrawn orientation to a vertical orientation when drawn;

a peep sight (26) positioned within the opening in the draw string, the peep sight having generally bi-convex curved external surfaces (28) with a vertical, mid-plane and a horizontal aperture (30) there through when in the drawn orientation, the exterior surface of the peep sight having an annular recess (32) at the vertical mid-plane, the annular recess having a rectangular cross sectional configuration with a width and a depth, the width of the recess and the depth of the recess being essentially equal, the exterior surface of the peep sight having planar end faces (34) parallel with each other and vertically oriented when in the drawn orientation;

the horizontal aperture having a central axis, the horizontal aperture being formed with opposed frusto-conical surfaces (38) extending entirely around the central axis, the frusto-conical surfaces having interior edges (40) at the vertical mid-plane and exterior edges (42) at the planar end faces, the exterior edges being larger than the interior edges, the frusto-conical surfaces being planar and forming an angle of 60 degrees, plus or minus 10 percent; and coupling grooves (46) formed in the exterior surface of the peep sight, the coupling grooves extending to opposite sides of the recess, the coupling grooves having a generally semi-circular configuration with a depth essentially equal to the depth of the recess, the grooves being parallel with each other at an angle of 34 degrees, plus or minus 10 percent, the grooves having midpoints spanning the central axis, the coupling grooves receiving the separated strands whereby, when the draw string is drawn, the peep sight will rise to a level of an eye of the user with the opening and central axis in an intended direction of the target.

* * * * *